US010256567B2

(12) United States Patent
Matsuura et al.

(10) Patent No.: US 10,256,567 B2
(45) Date of Patent: Apr. 9, 2019

(54) CONNECTOR WITH WIRE COVER

(71) Applicants: SUMITOMO WIRING SYSTEMS, LTD., Yokkaichi-shi, Mie (JP); NISSAN MOTOR CO., LTD., Yokohama-shi, Kanagawa (JP)

(72) Inventors: Masahito Matsuura, Yokkaichi (JP); Ryo Sawada, Yokohama (JP)

(73) Assignees: Sumitomo Wiring Systems, Ltd. (JP); Nissan Motor Co., Ltd. (JP)

( * ) Notice: Subject to any disclaimer, the term of this patent is extended or adjusted under 35 U.S.C. 154(b) by 0 days.

(21) Appl. No.: 15/751,546

(22) PCT Filed: Aug. 8, 2016

(86) PCT No.: PCT/JP2016/073272
§ 371 (c)(1),
(2) Date: Feb. 9, 2018

(87) PCT Pub. No.: WO2017/026437
PCT Pub. Date: Feb. 16, 2017

(65) Prior Publication Data

US 2018/0226744 A1 Aug. 9, 2018

(30) Foreign Application Priority Data

Aug. 10, 2015 (JP) ..... 2015-157904

(51) Int. Cl.
*H01R 13/56* (2006.01)
*H01R 13/58* (2006.01)
(Continued)

(52) U.S. Cl.
CPC ..... *H01R 13/582* (2013.01); *H01R 13/506* (2013.01); *H01R 13/56* (2013.01);
(Continued)

(58) Field of Classification Search
CPC .... H01R 13/582; H01R 13/506; H01R 13/56; H01R 13/5841; H01R 13/629;
(Continued)

(56) References Cited

U.S. PATENT DOCUMENTS 4,549,780 A * 10/1985 Bertini ..... H01R 13/46 439/465
4,629,276 A * 12/1986 Genaro ..... H01R 13/5841 439/449
(Continued)

FOREIGN PATENT DOCUMENTS

JP 8-298160 11/1996
JP 11-354243 12/1999
(Continued)

OTHER PUBLICATIONS

International Search Report dated Oct. 11, 2016.

*Primary Examiner* — Edwin A. Leon
*Assistant Examiner* — Oscar C Jimenez
(74) *Attorney, Agent, or Firm* — Gerald E. Hespos; Michael J. Porco; Matthew T. Hespos

(57) ABSTRACT

A wire cover (30) can be mounted to a connector body (C) in any one of a first direction and a second direction opposite to the first direction with respect to a wire drawing port (31). A first mark (M1) and a second mark (M2) having different appearance from each other are provided in the wire cover (30). A first identification mark (S1) is provided on one of both side surfaces of the connector body (C) and a second identification mark (S2) is provided on the other side surface. When the wire cover (30) is mounted in the first direction, the first mark (M1) and the first identification mark (S1) are disposed close to each other. When the wire
(Continued)

cover (30) is mounted in the second direction, the second mark (M2) and the second identification mark (S2) are close to each other.

4 Claims, 14 Drawing Sheets

(51) Int. Cl.
*H01R 13/64* (2006.01)
*H01R 43/18* (2006.01)
*H01R 13/506* (2006.01)
*H01R 13/629* (2006.01)

(52) U.S. Cl.
CPC ..... *H01R 13/5841* (2013.01); *H01R 13/629* (2013.01); *H01R 13/6295* (2013.01); *H01R 13/62938* (2013.01); *H01R 13/62955* (2013.01); *H01R 13/64* (2013.01); *H01R 43/18* (2013.01)

(58) Field of Classification Search
CPC ..... H01R 13/62938; H01R 13/6295; H01R 13/64; H01R 13/641; H01R 43/18
USPC ..... 439/489
See application file for complete search history.

(56) References Cited

U.S. PATENT DOCUMENTS 4,761,145 A * 8/1988 Goto ..... H01R 13/516 439/469
4,952,168 A * 8/1990 Schieferly ..... H01R 13/501 439/467
5,076,802 A * 12/1991 Colleran ..... H01R 13/516 439/468
5,735,702 A 4/1998 Hio
6,338,645 B1 * 1/2002 Tan ..... H01R 13/5841 439/446
7,063,547 B2 * 6/2006 Toyoda ..... H01R 13/62911 439/157
8,197,271 B2 * 6/2012 Kobayashi ..... H01R 13/62955 439/157
8,911,263 B2 * 12/2014 Becavin ..... H01R 13/64 439/680
2002/0019156 A1 2/2002 Fukamachi et al.
2014/0321810 A1 * 10/2014 Leigh ..... H01R 13/641 385/71
2016/0006162 A1 * 1/2016 Andresen ..... H01R 13/5841 439/587

FOREIGN PATENT DOCUMENTS

JP 2002-56934 2/2002
JP 2006-302761 11/2006

* cited by examiner

CONNECTOR WITH WIRE COVER

BACKGROUND

Field of the Invention

The present invention relates to a connector with a wire cover.

Description of the Related Art

Conventionally, a connector to which a wire cover for bending and drawing a wire in a predetermined direction is mounted at a rear side of a housing is known. For example, in a connector disclosed in JP H08-298160 A, a wire cover can be mounted in two ways in which wire drawing port is directed in opposite directions. Accordingly, a drawing direction of a wire can be selectively changed from two directions using a single wire cover.

However, in the connector as described above, a correct mounting direction of the wire cover might not be easily checked because the wire cover can be selectively mounted in the two directions.

The present invention is completed taking account of the problem described above, and an object of the present invention is to provide a connector with a wire cover in which a drawing direction of a wire can be changed using a single wire cover and that makes it possible to easily check a direction of the wire cover.

SUMMARY

A connector with a wire cover according to the present invention includes a connector body to be connected to a terminal of a wire, and a wire cover mounted to a rear surface of the connector body to bend and draw the wire in a predetermined direction. The wire cover can be mounted to the connector body in any one of a first direction in which a wire drawing port is directed in one direction, and a second direction in which the wire drawing port is directed in a direction opposite to the first direction. A first mark and a second mark having different appearances from each other are provided on an outer surface of a wall portion of the wire cover, the wall portion being located at a side opposite to the wire drawing port. A first identification mark corresponding to the first mark is provided on one of both side surfaces of the connector body, and a second identification mark corresponding to the second mark is provided on the other side surface. When the wire cover is mounted in the first direction, the first mark and the first identification mark are disposed close to each other. When the wire cover is mounted in the second direction, the second mark and the second identification mark are disposed close to each other. Here, the side surface of the connector body refers to a surface intersecting with the drawing direction of the wire from the wire cover, among the outer surfaces of the connector body.

The first identification mark or the second identification mark may be protrude from the side surface of the connector body. According to such a configuration, the first identification mark or the second identification mark can be formed using a molding die that is opened and closed in a front-rear direction.

The connector body may include a housing that can fit with a mating connector, and a lever that is rotated from an initial position to a final position for fitting the mating connector and the housing properly with each other. When the lever has reached the final position, the first identification mark or the second identification mark provided on the lever may be disposed at a position corresponding to the first mark or the second mark. According to such a configuration, a positional relationship between the identification mark provided on the lever and the mark provided on the wire cover to check that the lever has reached the final position.

According to the present invention, the direction of the wire cover can be easily checked by the mark of the wire cover and the identification mark of the connector body.

DETAILED DESCRIPTION

Figure 1:
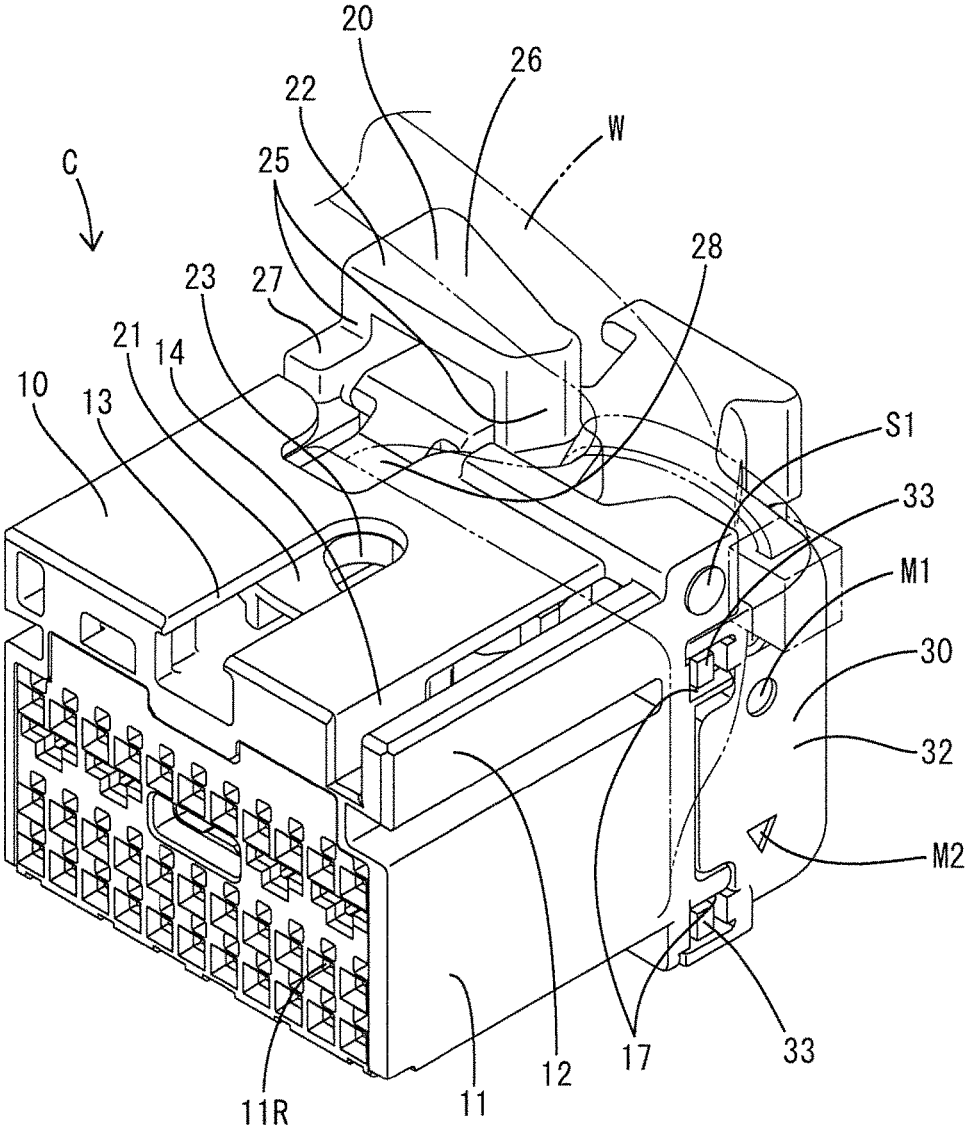
FIG. 1 is a perspective view illustrating a connector with a wire cover according to an example of the present invention.

Hereinafter, an example embodying the present invention will be described in detail with reference to FIGS. 1 to 14.

A connector with a wire cover according to the present example (hereinafter, simply referred to as a connector) includes a connector body C to be connected to a terminal of a wire W, and a wire cover 30 which bends and draws the wire W in a predetermined direction. The connector body C includes a housing 10 in which a terminal metal fitting (not shown) connected to a terminal portion of the wire W is housed, and a lever 20 which fits the housing with a mating connector 40 and releases the housing from the mating connector 40 when rotationally operated. Hereinafter, in each component, a side of a fitting surface of each of the connectors (a left side in FIG. 2 for the connector body C and a right side in FIG. 2 for the mating connector 40) is defined as a front side. Further, an upper side and a lower side of FIG. 1 as printed are defined as an upper side and a lower side, respectively, and a vertical direction of FIG. 2 is defined as a lateral direction.

Figure 2:
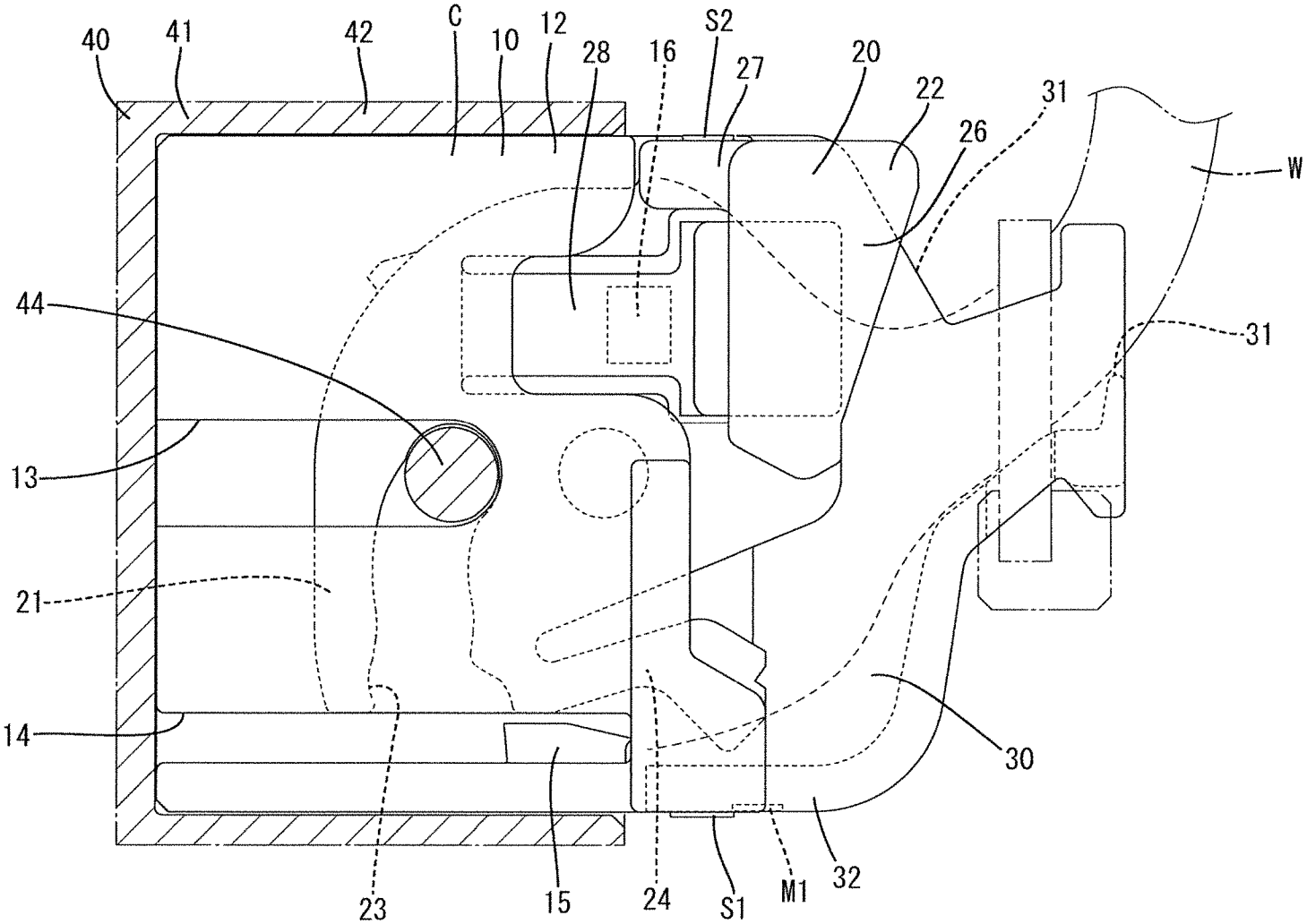
FIG. 2 is a cross-sectional view illustrating the connector properly fitted with a mating connector.

A housing 41 of the mating connector 40 is formed of synthetic resin, and as shown in FIG. 2, the housing 41 includes a hood portion 42 opened toward the front side thereof. A cam pin 44 having a cylindrical shape is formed on the upper wall of the hood portion 42 so as to protrude toward the lower side (toward an inner space of the hood portion 42). The cam pin 44 is provided at a position closer to a front end than a center of the hood portion 42 in a front-rear direction.

The housing 10 is formed of synthetic resin. The housing 10 includes a terminal housing portion 11 in which a plurality of terminal metal fittings is housed, and a lever housing portion 12 in which the lever 20 is housed. The housing 10 is, as a whole, formed in a substantially block shape which can be fitted in the hood portion 42 of the mating connector 40.

The terminal housing portion 11A is provided with a plurality of terminal housing chambers 11R in which the terminal metal fittings are individually housed. The terminal housing chambers 11R are separated into several rows in a vertical direction and aligned in the lateral direction in each row. When the metal fitting is housed in each of the terminal housing chambers 11R from the rear side, the wire W becomes a state of being drawn from a rear surface of the housing 10.

The lever housing portion 12 has a size extending over substantially the whole range in a width direction of the upper surface of the housing 10 and has a rear end portion protruding toward the rear side relative to the rear surface of the housing 10. As shown in FIG. 2, the lever housing portion 12 is provided with a first receiving path 13 which receives the cam pin 44 of the mating connector 40 and a second receiving path 14 which receives a lock releasing portion not shown. Each of the first receiving path 13 and the second receiving path 14 linearly extends from the front end of the lever housing portion 12 toward the rear side. The first receiving path 13 is located at substantially the center of the housing 10 in the width direction, and the second receiving path 14 is located at one end side of the housing 10 in the width direction.

Further, the lever housing portion 12 is provided with an initial lock portion 15 with which an initial lock piece 24 provided on the lever 20 can be locked. The initial lock portion 15 is provided to be protruding at a position closer to a rear end of the second receiving path 14.

Further, the lever housing portion 12 is provided with a final lock portion 16 with which a final lock piece 28 provided on the lever 20 can be locked. The final lock portion 16 is provided at a position closer to a rear end of the lever housing portion 12 (see FIG. 4). The final lock portion 16 protrudes from the lower surface of the lever housing portion 12.

Figure 9:
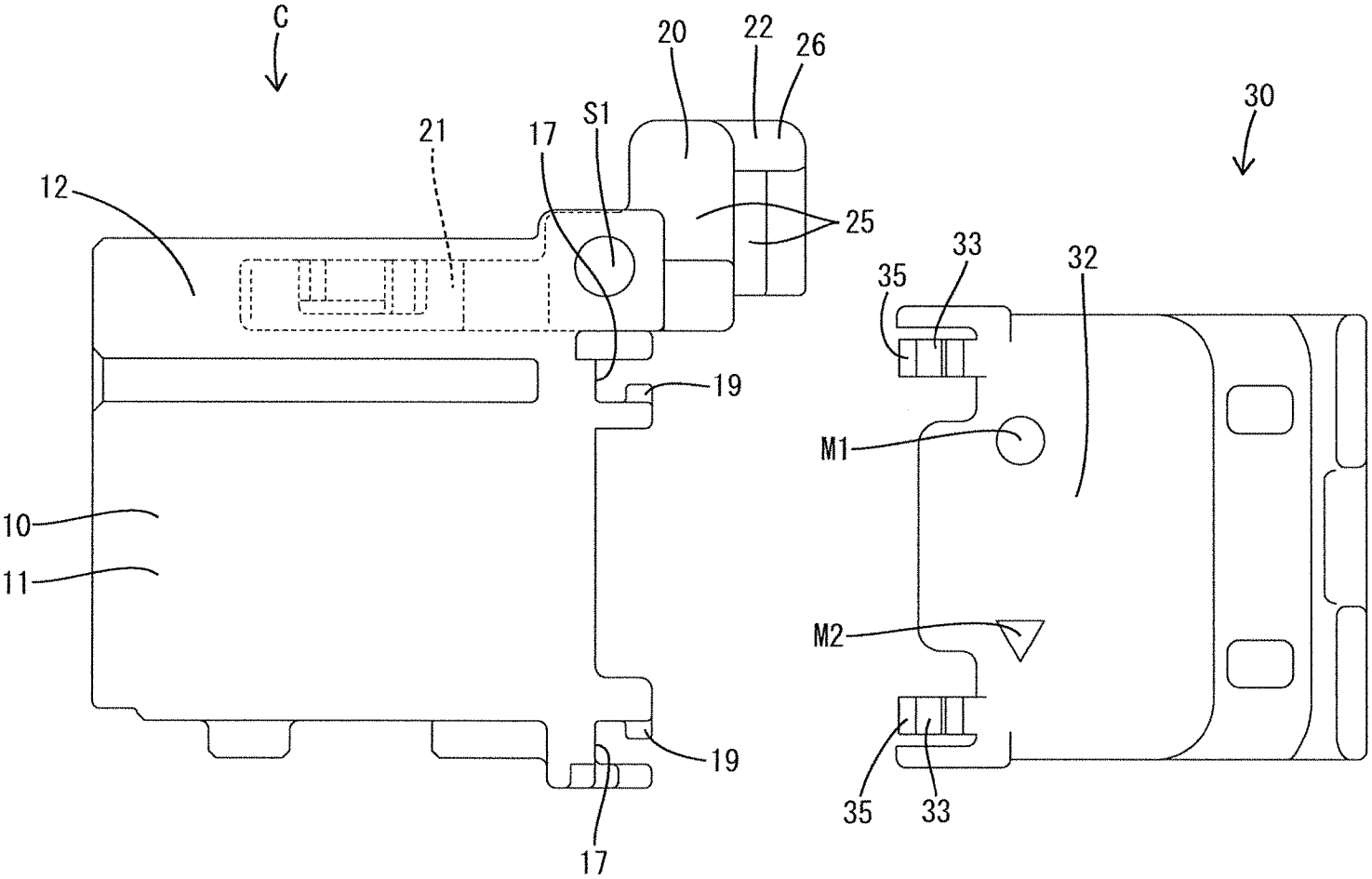
FIG. 9 is a side view of the connector illustrating a mark and an identification mark when the wire cover is to be mounted in a first direction.

A rear surface of the housing 10A is provided with cover mount portions 17 to which the wire cover 30 is mounted while sliding in the lateral direction (for example, see FIG. 9). The cover mount portions 17 are provided at both upper and lower sides of the housing 10, and each of the cover mount portions 17 is formed as a space opened to the rear side and to both right and left sides. The cover mount portions 17 are formed along an upper edge and a lower edge of the terminal housing portion 11, respectively, so as to protrude toward the rear side. Further, the cover mount portion 17 at the lower side is formed on the lower surface of the housing 10 so as to protrude toward the lower side.

Figure 11:
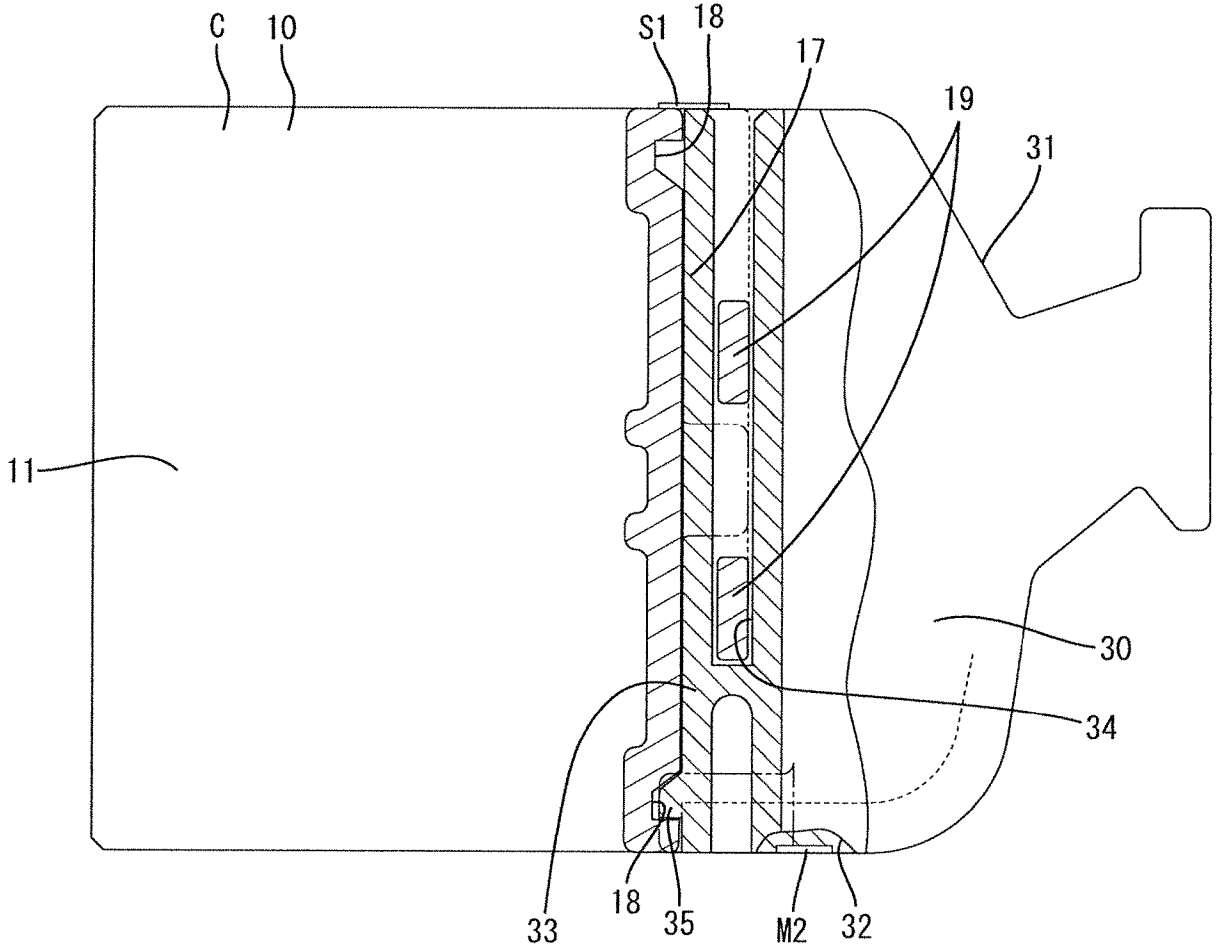
FIG. 11 is a cross-sectional view of the connector illustrating a state in which the wire cover has been mounted in the first direction.
Figure 12:
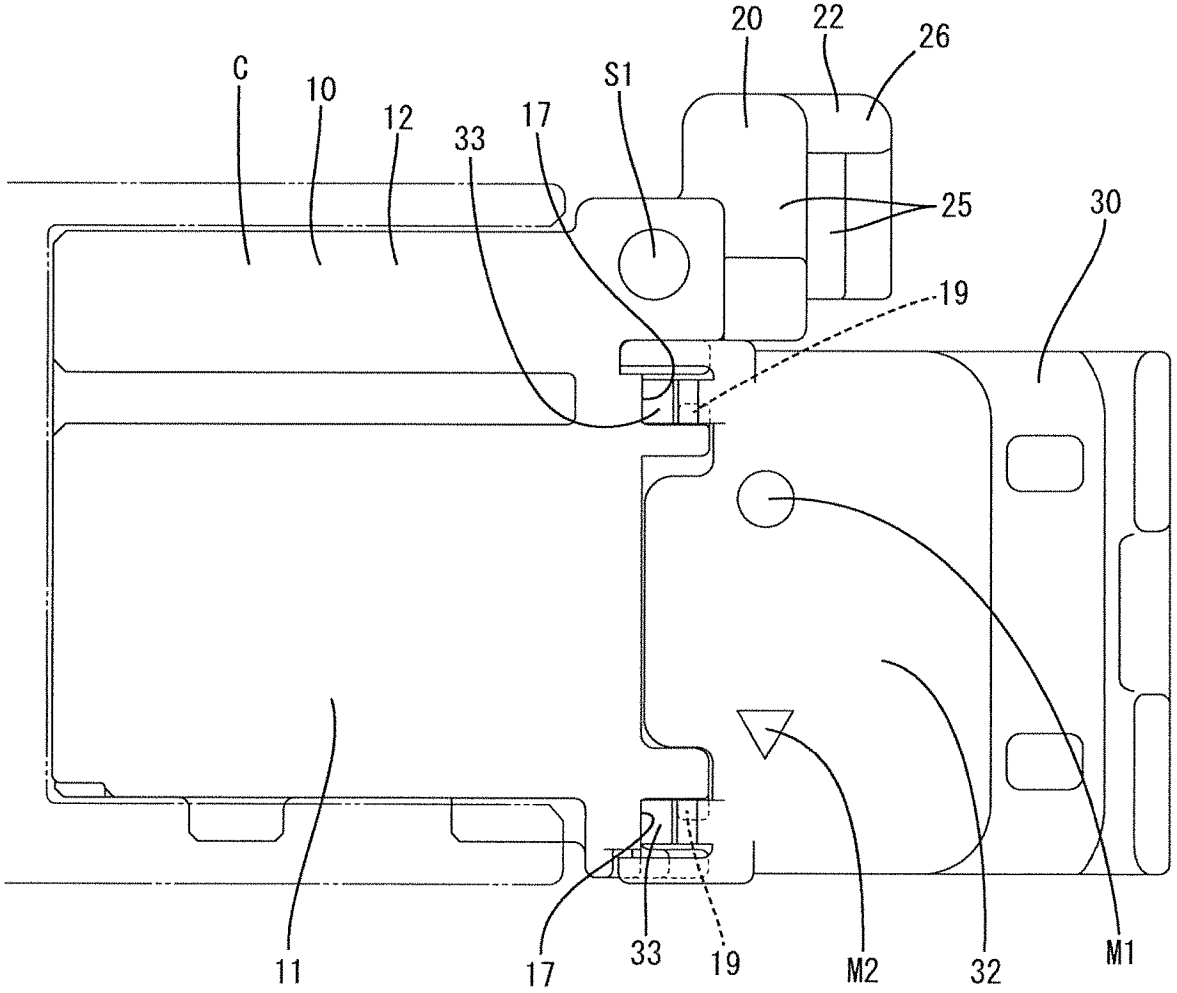
FIG. 12 is a side view of the connector illustrating the state in which the wire cover has been mounted in the first direction.

Each of the upper and lower cover mount portions 17 is formed over the whole width of the housing 10. As shown in FIG. 11, each of right and left end portions of each of the cover mount portions 17 is provided with a lock portion 18 with which a lock piece 35 provided in the wire cover 30 can be locked. Further, each of the cover mount portions 17 is provided with guide ribs 19 which guide a slide movement of the wire cover 30. The guide ribs 19 are erected at plural positions along a rear end edge of each of the cover mount portions 17.

Figure 5:
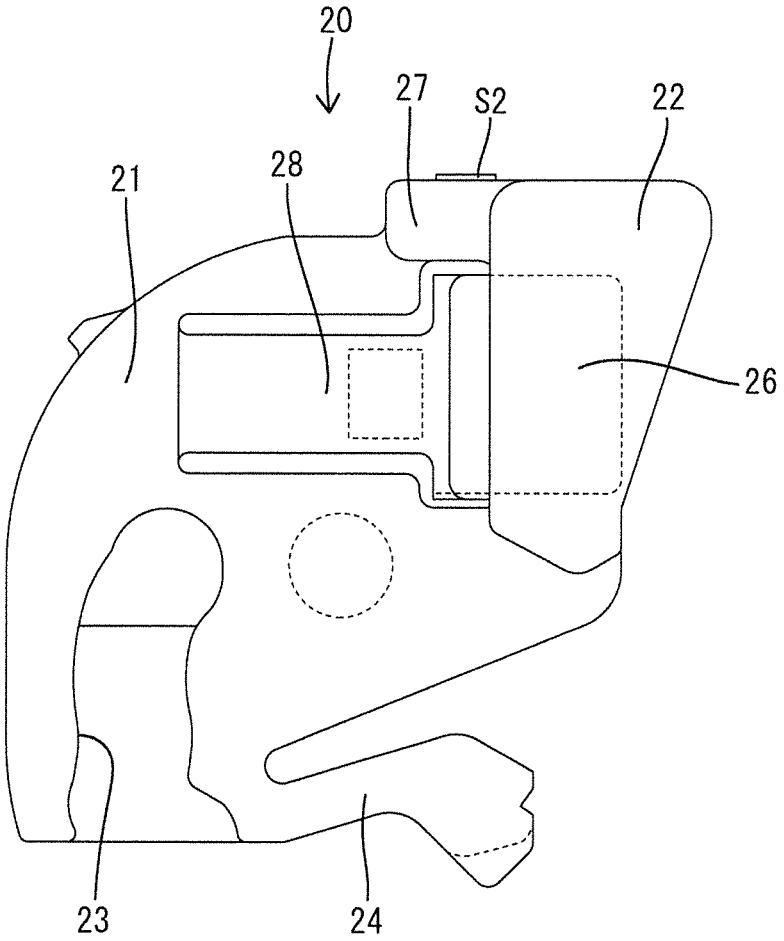
FIG. 5 is a plan view illustrating a lever.

The lever 20 is formed as a rotatable lever. As shown in FIG. 5, the lever 20 includes a cam plate portion 21 formed of synthetic resin and having a plate shape, and an operation portion 22 to be touched and operated by fingers when the lever 20 is rotated. The cam plate portion 21 of the lever 20 is assembled in the lever housing portion 12 with a slight clearance, and the operation portion 22 protrudes toward the rear side from the lever housing portion 12. The lever 20 is positioned in an initial position before the fitting with the mating connector 40 and is rotationally operated to a final position thereby to be able to fit the connector properly.

An upper surface of the cam plate portion 21A is formed with a cam groove 23 with which the cam pin 44 of the mating connector 40 is engaged (see FIG. 5). The cam groove 23 is formed as a recessed portion extending from an edge of the cam plate portion 21 toward a center thereof. When the lever 20 is positioned in the initial position, an inlet of the cam groove 23 is located at the first receiving path 13 so that the cam groove 23 can receive the cam pin 44.

The cam plate portion 21 is provided with an initial lock piece 24 which holds the lever 20 to be positioned in the initial position by being locked with the initial lock portion 15 of the lever housing portion 12 when the lever 20 is positioned in the initial position. The initial lock piece 24 is formed in a cantilever manner so as to be extended from a position near the inlet of the cam groove 23, and a distal end thereof in an extending direction is to be locked with the initial lock portion 15.

Further, the cam plate portion 21 is provided with a final lock piece 28 which is locked with the final lock portion 16 of the lever housing portion 12 when the lever 20 has reached the final position. The final lock piece 28 is formed in a cantilever manner so as to be elastically deformed in a plate thickness direction (the vertical direction) of the cam plate portion 21. The final lock portion 16 can be locked with a lower surface of the final lock piece 28.

Figure 3:
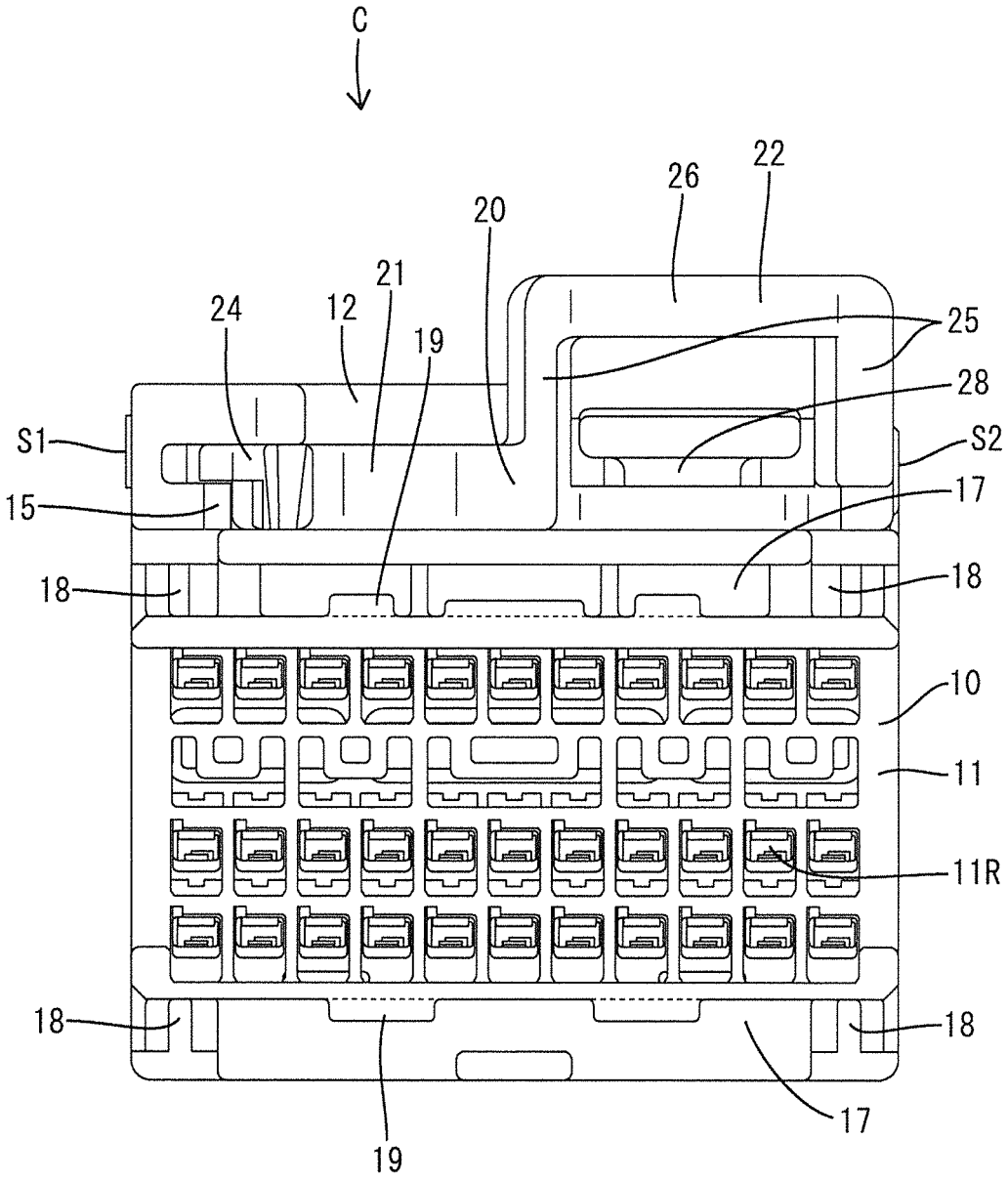
FIG. 3 is a rear view illustrating a connector body.
Figure 4:
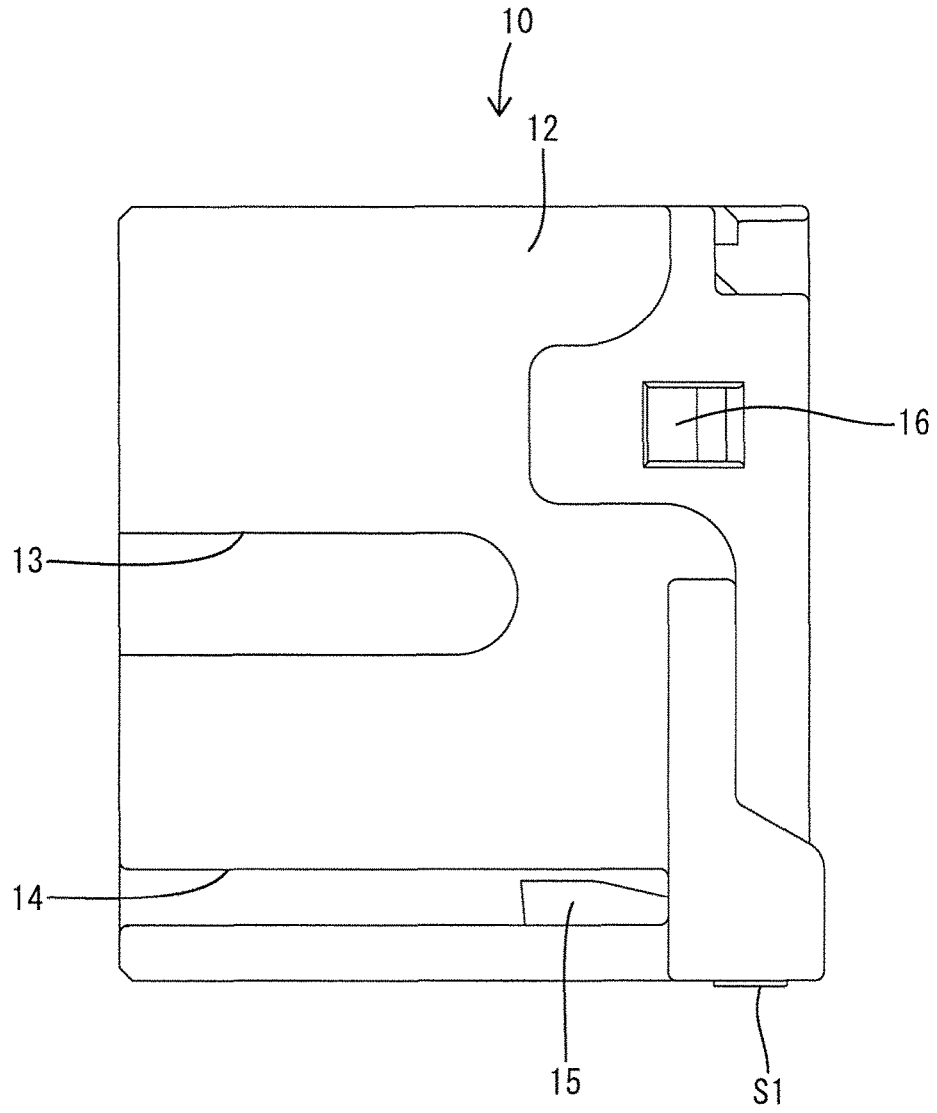
FIG. 4 is a plan view illustrating a housing.

The operation portion 22 is erected on the upper surface of the cam plate portion 21. As shown in FIG. 3, the operation portion 22 is formed in such a U-shape as to cover an end portion at a free end side of the final lock piece 28. The operation portion 22 includes a pair of side walls 25 erecting at both sides of the final lock piece 28, and an upper wall 26 that is bridged between upper ends of the side walls 25.

Figure 6:
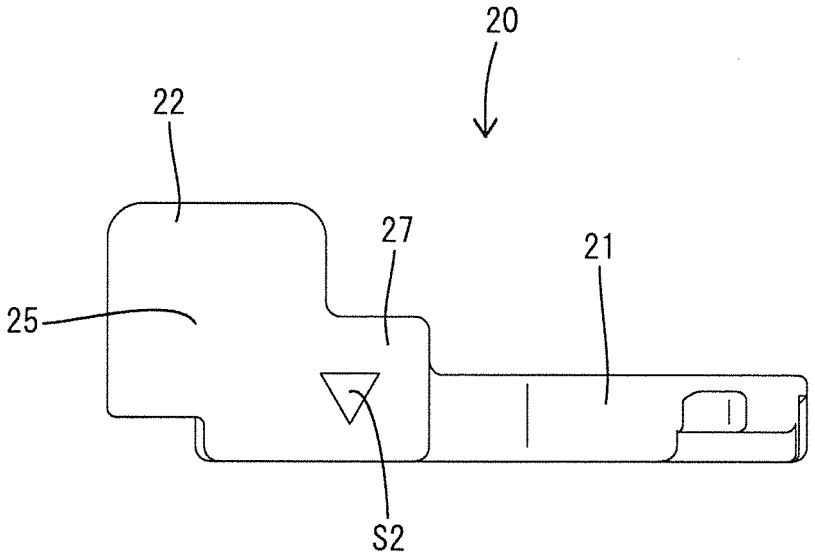
FIG. 6 is a side view illustrating the lever.

As shown in FIGS. 5 and 6, a protrusion wall 27 protrudes on the side wall 25 at a side along an outer peripheral surface of the cam plate portion 21 among a pair of the side walls 25. The protrusion wall 27 has a height lower than a height of the side wall 25. A wall thickness of the protrusion wall 27 is substantially the same as a wall thickness of the side wall 25, and the protrusion wall 27 and the side wall 25 have respective wall surface that are continued without a step. The protrusion wall 27 protrudes toward an outer side from the outer peripheral surface of the cam plate portion 21. Further, in a state where the lever 20 is disposed at the final position, a front end of the protrusion wall 27 is disposed close to a rear end of the lever housing portion 12 (see FIG. 2).

Further, the connector body C is provided with a first identification mark S1 and a second identification mark S2. The first identification mark S1 and the second identification mark S2 are described later in detail.

Figure 7:
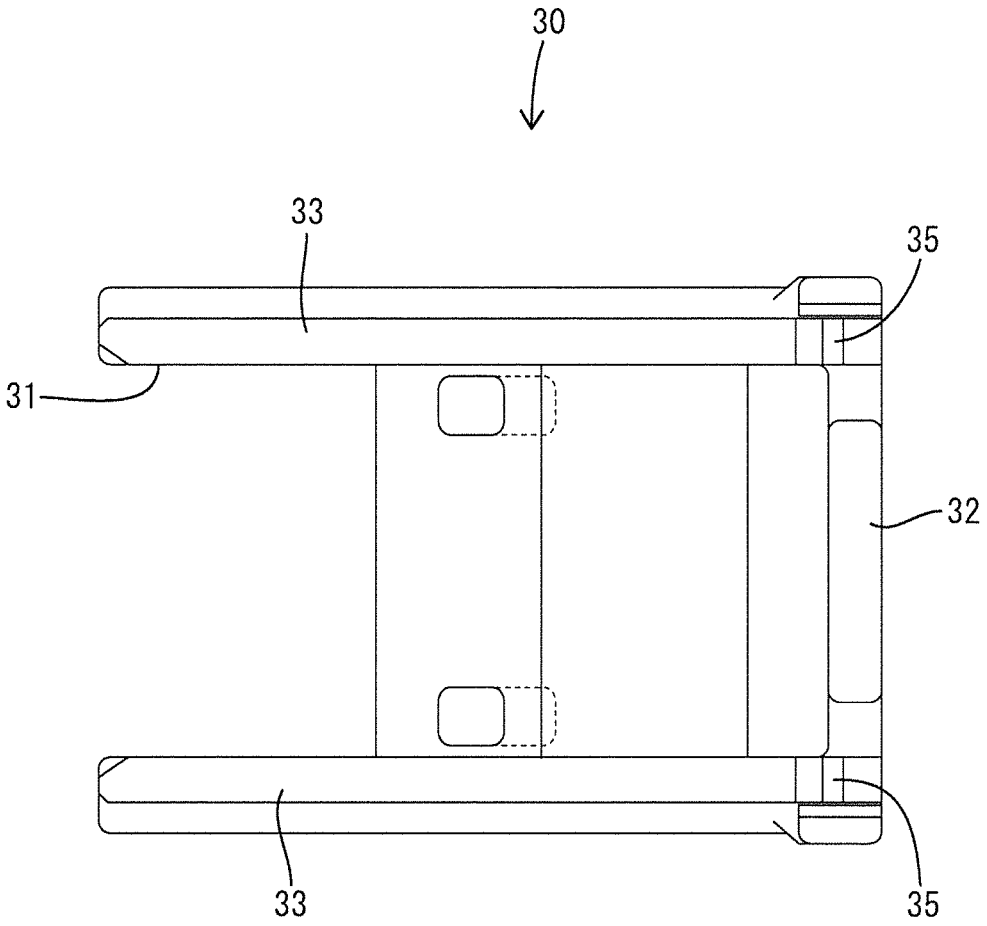
FIG. 7 is a front view illustrating the wire cover.
Figure 8:
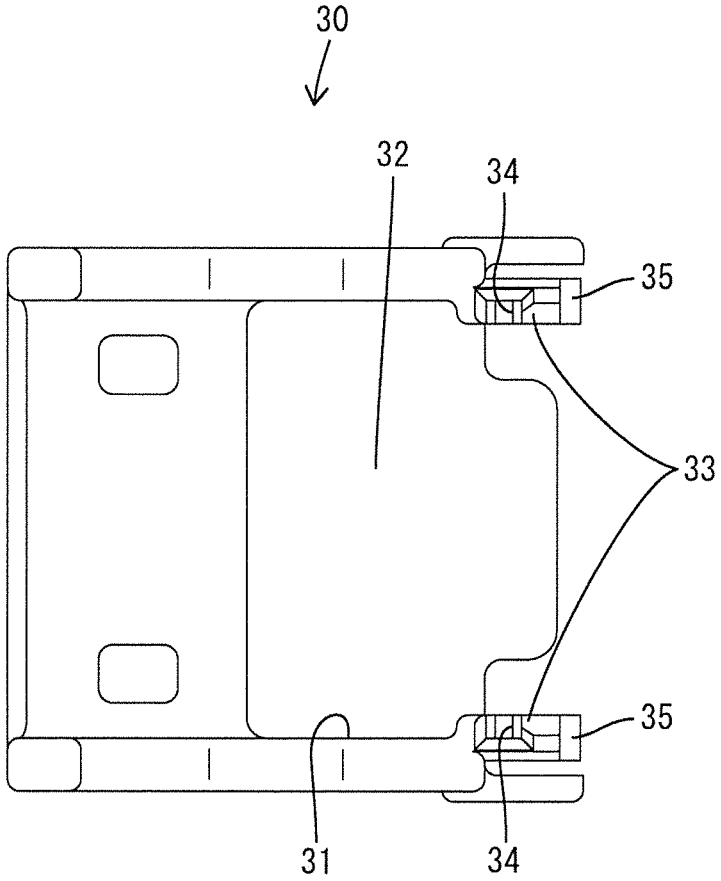
FIG. 8 is a side view illustrating the wire cover.

The wire cover 30 is to be mounted to the rear surface of the connector body C. As shown in FIGS. 7 and 8, the wire cover 30 is formed to have a U-shaped cross-section being opened at a front surface side, and formed to be opened at only one end side in the lateral direction. Further, the wire W drawn from the housing 10 is bent in the wire cover 30 and then drawn from an opening side of the wire cover 30 (hereinafter, referred to as a wire drawing port 31).

As shown in FIG. 2, in a state in which the wire cover 30 is mounted to the connector body C, a wall portion 32 located opposite to the wire drawing port 31 in the wire cover 30 is substantially orthogonal to the rear surface of the housing 10, and is continued to a right side surface or a left side surface of the housing 10 (a surface intersecting with a drawing direction of the wire W) without a step. Further, a size of the wire cover 30 in the lateral direction is substantially the same as a size of the housing 10 in the lateral direction.

Figure 10:
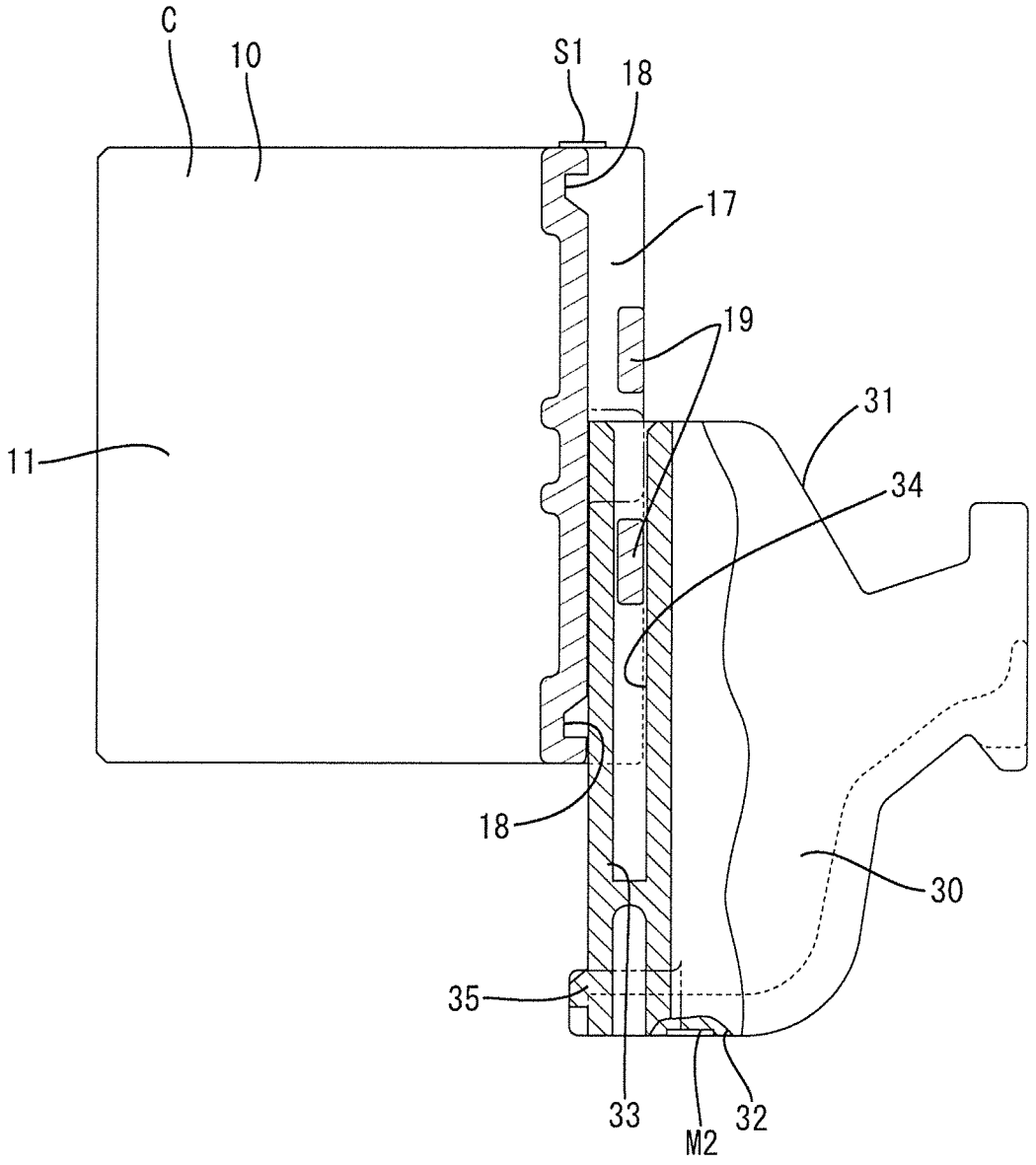
FIG. 10 is a cross-sectional view of the connector illustrating a state in which the wire cover is being mounted in the first direction.

As shown in FIG. 10, a front edge portion of the wire cover 30 is formed with a slide portion 33 which can be slid in the lateral direction along the cover mount portion 17 of the housing 10. The slide portions 33 are provided at both upper and lower sides of the wire cover 30, and each of the slide portions 33 is extended in the lateral direction.

The slide portion 33 is formed with a slide groove 34 opened at one side in the lateral direction (a side of the wire drawing port 31) and closed at the other side. The guide rib 19 of the housing 10 is inserted into the slide groove 34.

The slide portion 33 is provided with a lock piece 35 which can be locked with the lock portion 18 of the housing 10. The lock piece 35 is provided at an end portion of the slide portion 33 at the wall portion 32 side of the wire cover 30 (an end portion at the rear side in a slide direction in mounting). The lock piece 35 is formed in a cantilever manner so as to be extended toward the rear side (a lower side in FIG. 10) in the slide direction in mounting.

Further, the right and left sides of the wire cover 30 can be reversed when mounted to the housing 10. That is, the wire cover 30 can be mounted to the connector body C in any one of a first direction (see FIG. 12) in which the wire drawing port 31 is directed toward the right side (one direction) and a second direction (see FIG. 14) in which the wire drawing port 31 is directed toward the left side (a direction opposite to the one direction).

For example, as shown in FIG. 9, the wire cover 30 is provided with a first mark M1 and a second mark M2 having different appearances from each other. The first mark M1 and the second mark M2 have different shapes from each other. For example, the first mark M1 is formed in a circular shape and the second mark M2 is formed in a triangular shape (an equilateral triangle in which one apex is located at lower center position). A diameter of the first mark M1 and a length of one side of the second mark M2 are set in substantially the same dimension.

The first mark M1 and the second mark M2 are provided on the outer surface of the wall portion 32 (a rear end surface in the slide direction of the wire cover 30). On the outer surface of the wall portion 32, each of the first mark M1 and the second mark M2 is formed as a recess having a predetermined depth without penetrating the wall portion 32.

The first mark M1 and the second mark M2 are aligned in the vertical direction, and one of them is located at the upper side with respect to the center in the vertical direction and the other one is located at the lower side with respect to the center. The first mark M1 and the second mark M2 are arranged at substantially the same position in the front-rear direction. Further, when the wire cover 30 is mounted in the first direction, the first mark M1 is to be located at the upper side (see FIG. 9). When the wire cover 30 is mounted in the second direction, the second mark M2 is to be located at the upper side (see FIG. 13).

The connector body C is provided with a first identification mark S1 and a second identification mark S2 corresponding to the first mark M1 and the second mark M2, respectively. The first identification mark S1 is provided on a left surface of the connector body C (one of both side surfaces), and the second identification mark S2 is provided on a right surface (the other surface). Further, when the wire cover 30 is mounted in the first direction, the first mark M1 and the first identification mark S1 are disposed close to each other. When the wire cover 30 is mounted in the second direction, the second mark M2 and the second identification mark S2 are disposed close to each other. The left surface and the right surface of the connector body C are substantially orthogonal to the drawing direction in which the wire W is drawn from the wire cover 30.

The first identification mark S1 and the second identification mark S2 are formed in the same shape as the corresponding marks M1 and M2, respectively; that is, the first identification mark S1 is formed in a circular shape and the second identification mark S2 is formed in a triangular shape (an equilateral triangle in which one apex is located at the lower center position). The first identification mark S1 and the second identification mark S2 are arranged in the connector body C so as to be substantially symmetry in the lateral direction (substantially the same position in the height direction and the front-rear direction). The first identification mark S1 is formed to be larger than the first mark M1, and the second identification mark S2 is formed in substantially the same size as the second mark M2.

As shown in FIG. 9, the first identification mark S1 is provided on the left surface of the housing 10. The first identification mark S1 is formed at a portion that is an upper end corner in the rear end portion of the housing 10 and is the rear end portion of the lever housing portion 12. The first identification mark S1 protrudes on the side surface of the housing 10 with a certain protrusion size.

As shown in FIG. 6, the second identification mark S2 is provided on the operation portion 22 of the lever 20. The second identification mark S2 is formed on the protrusion wall 27 of the operation portion 22. When the lever 20 is in the final position of the rotation operation of the lever 20, the second identification mark S2 is disposed at a right surface side of the connector body C. The second identification mark S2 protrudes on the protrusion wall 27 of the lever 20 with a certain protrusion size, which is the same as the protrusion size of the first identification mark S1.

Next, an example of mounting operation of the wire cover 30 in the connector according to the present example will be described.

At first, the wire cover 30 is set in a predetermined direction against the connector body C. At this time, the lever 20 is set in the final position.

In a case where the wire cover 30 is mounted in the first direction, as shown in FIG. 9, the first mark M1 of the wire cover 30 is set to correspond to the first identification mark S1 of the connector body C. That is, the wire cover 30 is set such that the first mark M1 is located at the upper side and the second mark M2 is located at the lower side and such that the wall portion 32 is disposed at a side of the first identification mark S1 of the connector body C.

Figure 13:
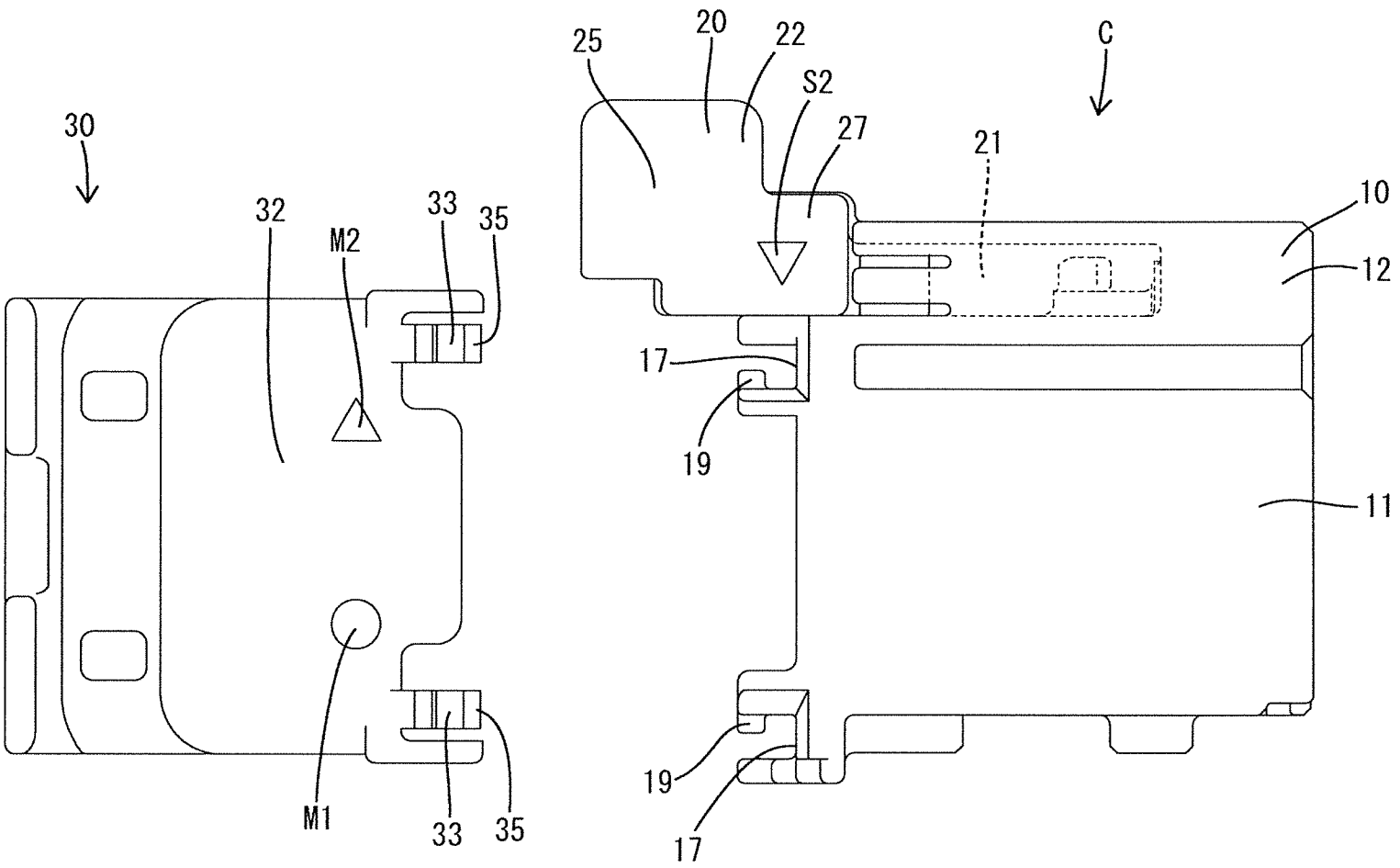
FIG. 13 is a side view of the connector illustrating a mark and an identification mark when the wire cover is to be mounted in a second direction.

On the other hand, in a case where the wire cover 30 is mounted in the second direction, as shown in FIG. 13, the second mark M2 of the wire cover 30 is set to correspond to the second identification mark S2 of the connector body C. That is, the wire cover 30 is set such that the second mark M2 is located at the upper side and the first mark M1 is located at the lower side and such that the wall portion 32 is disposed at a side of the second identification mark S2 of the connector body C.

Then, as shown in FIG. 10, the wire cover 30 is slid in the lateral direction so that the wire cover 30 is mounted to the housing 10. The slide portion 33 of the wire cover 30 is inserted into the cover mount portion 17 from the wire drawing port 31 first, and then the guide rib 19 of the housing 10 is inserted to be slid in the slide groove 34 of the wire cover 30. Consequently, the wire W is bent and housed in the wire cover 30. As shown in FIG. 1, when the guide rib 19 has reached the closed end portion of the slide groove 34, the lock piece 35 is locked with the lock portion 18, and thereby the slide movement in an opposite direction is restricted. Thus, the mounting operation of the wire cover 30 is completed.

Next, an example of fitting operation with the mating connector 40 will be described.

At first, the lever 20 is positioned in the initial position, and the cam pin 44 of the mating connector 40 is inserted into the inlet of the cam groove 23 by fitting the connector body C with the mating connector 40. At this time, locking between the initial lock piece 24 and the initial lock portion 15 is released by a lock releasing portion of the mating connector 40, and thereby the rotation operation of the lever 20 is allowed.

Subsequently, the lever 20 is rotated. When the lever 20 is rotated to the final position by pressing the operation portion 22 of the lever 20, the connector is moved closer to the mating connector 40 by a cam action due to the engagement between the cam pin 44 and the cam groove 23, and thereby the fitting proceeds.

Then, when the connector has reached the proper fitting position with respect to the hood portion 42, the terminal metal fitting and an opposite side terminal metal fitting are electrically connected to each other. Further, the final lock piece 28 of the lever 20 is locked with the final lock portion 16 of the housing 10, and thereby the rotation operation of the lever 20 toward the initial position is restricted.

Figure 14:
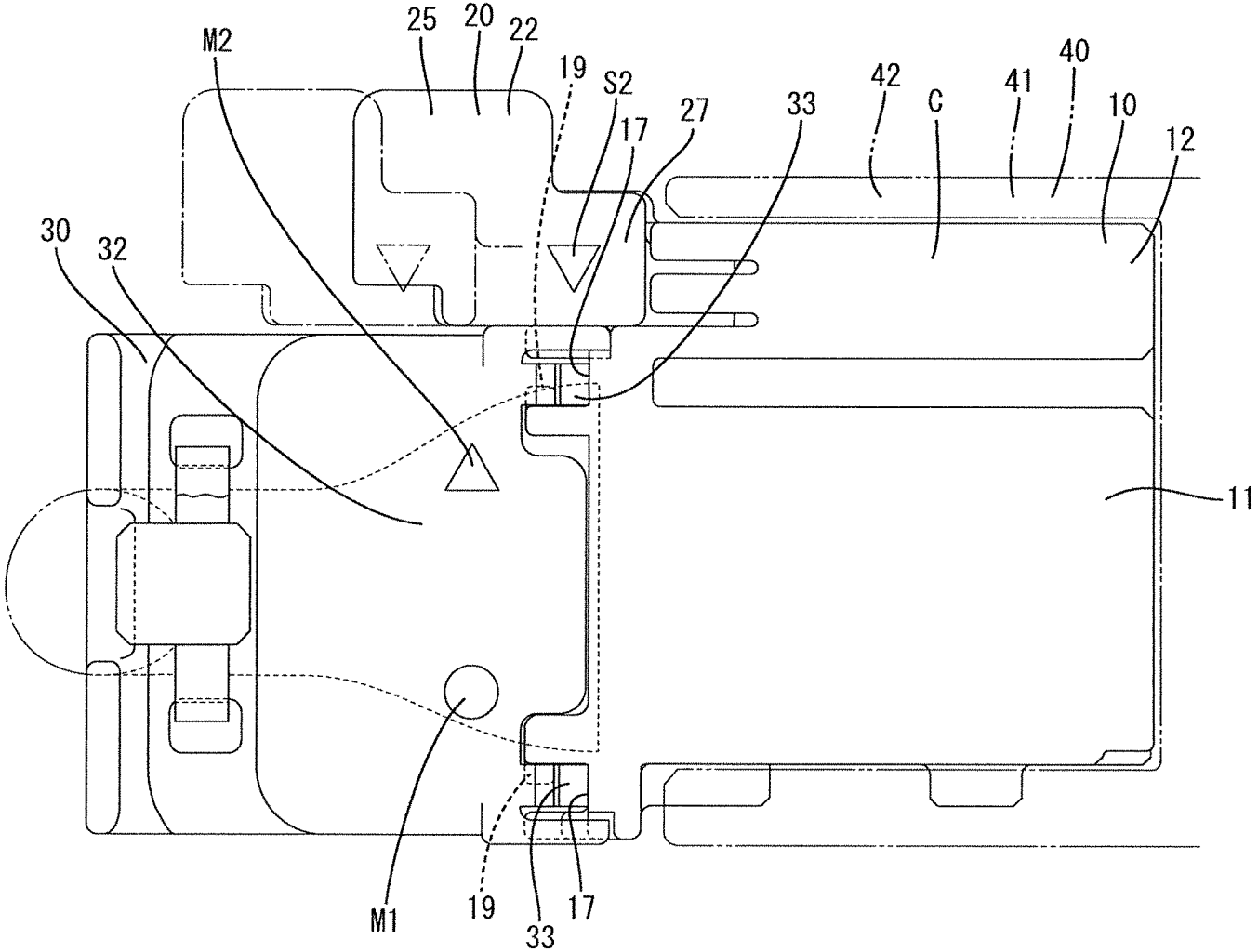
FIG. 14 is a side view of the connector illustrating a state in which the wire cover has been mounted in the second direction.

At this time, in a case where the wire cover 30 is mounted in the second direction, as shown in FIG. 14, the second identification mark S2 provided in the operation portion 22 is moved closer to the second mark M2 from the rear side of the second mark M2 of the connector body C in accordance with the rotation movement of the lever 20. When the lever 20 has reached the final position, the second identification mark S2 is positioned in front of the second mark M2 after passing above the second mark M2. Accordingly, also from the positional relationship between the second identification mark S2 and the second mark M2, it is recognized that the lever 20 has reached the final position, namely, that the connector and the mating connector 40 are fitted with each other properly. The fitting operation with the mating connector 40 is thus completed.

Next, functions and effects of the example formed as described above will be described.

The connector according to the present example includes the connector body C to be connected to the terminal of the wire W, and the wire cover 30 mounted to the rear surface of the connector body C to bend and draw the wire W in a predetermined direction. The wire cover 30 can be mounted to the connector body C in any one of the first direction in which the wire drawing port 31 is directed in the right direction and a second direction in which the wire drawing port 31 is directed in the left direction. The first mark M1 and the second mark M2 having different appearances from each other are provided on the outer surface of the wall portion 32 of the wire cover 30, the wall portion 32 being located at a side opposite to the wire drawing port 31. The first identification mark S1 corresponding to the first mark M1 is provided on the left side surface of the connector body C, and the second identification mark S2 corresponding to the second mark M2 is provided on the right side surface. When the wire cover 30 is mounted in the first direction, the first mark M1 and the first identification mark S1 are disposed close to each other. When the wire cover 30 is mounted in the second direction, the second mark M2 and the second identification mark S2 are disposed close to each other. According to this configuration, the direction of the wire cover 30 can be easily checked by the marks M1, M2 of the wire cover 30 and the identification marks S1, S2 of the connector body C.

Further, the first identification mark S1 protrudes from the side surface of the connector body C. According to this configuration, the first identification mark S1 can be formed using a molding die that is opened and closed in the front-rear direction.

Further, the connector body C includes the housing 10 that can fit with the mating connector 40, and the lever 20 which is rotated from the initial position to the final position thereby to be able to fit the mating connector 40 and the housing 10 properly with each other. When the lever 20 has reached the final position, the second identification mark S2 provided on the lever 20 is disposed at a position corresponding to the second mark M2. According to this configuration, it can be checked that the lever 20 has reached the final position, by the positional relationship between the second identification mark S2 and the second mark M2.

The present invention is not limited to the example that has been described with reference to the above descriptions and drawings, and for example, the following examples are also encompassed by the scope of the present invention.

In the example described above, a configuration in which the connector body C includes the housing 10 and the lever 20 is exemplary described. However, the present invention is not limited to the example, and can be applied to a configuration in which the connector body C does not include the lever. In such a configuration, the first identification mark and the second identification mark may be provided in the housing.

In the example described above, the first mark M1 is circular and the second mark M2 is triangular; however, the present invention is not limited to the example. The first and second marks may be formed in any shape such as a rectangular, a star or a character shape.

In the example described above, the first mark M1 and the first identification mark S1 are formed in the same shape, and the second mark M2 and the second identification mark S2 are formed in the same shapes; however, the present invention is not limited to the example. The first mark and the first identification mark as well as the second mark and the second identification mark are not necessarily formed in the same shapes as long as a corresponding relationship between the first mark and the first identification mark and a corresponding relationship between the second mark and the second identification mark can be recognized from respective appearances.

In the example described above, the first mark M1 and the second mark M2 are formed in the different shapes from each other; however, the present invention is not limited to the example. The first mark and the second mark may be formed in the same shape but have different colors.

In the example described above, the first identification mark S1 is provided in the housing 10 and the second identification mark S2 is provided in the lever 20; however, the present invention is not limited to the example. Both of the first identification mark and the second identification mark may be provided only in the housing or only in the lever.

In the example described above, each of the first identification mark S1 and the second identification mark S2 formed in the connector body C is formed as a protrusion portion; however, the present invention is not limited to the example. Each of the first identification mark and the second identification mark may not be protruded but be recessed contrary.

In the example described above, each of the first mark M1 and the second mark M2 formed in the wire cover 30 is formed as a recessed portion; however, the present invention is not limited to the example. Each of the first mark and the second mark may not be recessed and may be formed as a flat shape or protruded contrary.

In the example described above, the first identification mark S1 and the second identification mark S2 are located at the upper end corner of the rear end portion of the connector body C; however, the present invention is not limited to the example. Each of the first identification mark and the second identification mark may be arranged, for example, at the center portion in the vertical direction of the connector body or at the lower end portion. In such a case, the position of the mark of the wire cover may be changed in accordance with the position of the identification mark of the connector body.

In the example described above, when the lever 20 has reached the final position, the second identification mark S2 is positioned in front of the second mark M2 after passing above the second mark M2; however, the present invention is not limited to the example. For example, the second identification mark may be positioned right above the second mark when the lever has reached the final position as long as the second identification mark is positioned to correspond to the second mark

REFERENCE SIGNS LIST

C: connector body
M1: first mark
M2: second mark
S1: first identification mark
S2: second identification mark
W: wire
10: housing
20: lever
30: wire cover
31: wire drawing port
32: wall portion
40: mating connector

The invention claimed is:

1. A connector with a wire cover comprising:

a connector body to be connected to a terminal of a wire; and the wire cover mounted to a rear surface of the connector body to bend and draw the wire in a predetermined direction, wherein:

the wire cover can be mounted to the connector body in any one of a first direction in which a wire drawing port is directed in one direction, and a second direction in which the wire drawing port is directed in a direction opposite to the first direction;

a first mark and a second mark having different appearances from each other are provided on an outer surface of a wall portion of the wire cover, the wall portion being located at a side opposite to the wire drawing port;

a first identification mark identical in shape to the first mark is provided on one of both side surfaces of the connector body, and a second identification mark identical in shape to the second mark is provided on the other side surface; and the first mark and the first identification mark are disposed close to each other when the wire cover is mounted in the first direction, and the second mark and the second identification mark are disposed close to each other when the wire cover is mounted in the second direction.

2. The connector with the wire cover according to claim 1, wherein the first identification mark or the second identification mark is formed to be protruding from the side surface of the connector body.

3. The connector with the wire cover according to claim 2, wherein:

the connector body comprises a housing configured to fit with a mating connector, and a lever that is rotated from an initial position to a final position thereby to be able to fit the mating connector and the housing properly with each other;

the first identification mark is provided on the housing and the second identification mark is provided on the lever; and when the lever has reached the final position, the second identification mark provided on the lever is disposed at a position corresponding to the second mark.

4. The connector with the wire cover according to claim 1, wherein the connector body comprises a housing configured to fit with a mating connector, and a lever that is rotated from an initial position to a final position thereby to be able to fit the mating connector and the housing properly with each other;

the first identification mark is provided on the housing and the second identification mark is provided on the lever; and when the lever has reached the final position, the second identification mark is disposed at a position corresponding to the second mark.

* * * * *